US010905202B2

(12) United States Patent
Huang

(10) Patent No.: US 10,905,202 B2
(45) Date of Patent: Feb. 2, 2021

(54) BELT BUCKLE

(71) Applicant: Shang-Yu Huang, Changhua (TW)

(72) Inventor: Shang-Yu Huang, Changhua (TW)

( * ) Notice: Subject to any disclaimer, the term of this patent is extended or adjusted under 35 U.S.C. 154(b) by 0 days.

(21) Appl. No.: 16/516,071

(22) Filed: Jul. 18, 2019

(65) Prior Publication Data

US 2020/0022461 A1 Jan. 23, 2020

(30) Foreign Application Priority Data

Jul. 19, 2018 (TW) ..... 107209782 U

(51) Int. Cl.
*A44B 11/24* (2006.01)

(52) U.S. Cl.
CPC ..... *A44B 11/24* (2013.01)

(58) Field of Classification Search
CPC .. A44B 11/24; Y10T 24/4065; Y10T 24/4067
See application file for complete search history.

(56) References Cited

U.S. PATENT DOCUMENTS 2,714,753 A * 8/1955 Beuchat ..... A44B 11/24 24/178
2,775,011 A * 12/1956 Beuchat ..... A44B 11/24 24/178

* cited by examiner

*Primary Examiner* — Robert Sandy
(74) *Attorney, Agent, or Firm* — Che-Yang Chen; Law Office of Michael Chen

(57) ABSTRACT

A belt buckle may include a buckle cooperating with a belt body. The belt body includes a connecting portion formed at one end thereof, and a plurality of punch holes arranged at the other end of the belt body. The buckle has a frame, a spring, a prong, a control unit, and a cover, and a shaft is located at one end of the frame. The shaft of the frame is adapted to pivotally connect to the connecting portion of the belt body, and a connecting base is formed at the other end of the frame. The spring is installed in the connecting base, and an open groove is formed at a middle section of the connecting base. The control unit includes a dodging slot and a blocking portion located at positions corresponding to the open groove.

4 Claims, 7 Drawing Sheets

BELT BUCKLE

FIELD OF THE INVENTION

The present invention relates to a belt buckle and more particularly to a belt buckle that enables the belt body to easily slide out thereof.

BACKGROUND OF THE INVENTION

A belt for clothing basically comprises a long narrow belt body, and a metal buckle is fixed at one end of the belt body. The buckle has a frame, and a prong is pivotally arranged on one end of the frame, and a free end of the prong is pressed against the buckle. A plurality of punch holes are arranged on the other end of the belt body, so that after the belt body passes through the buckle to form a loop, the prong is selectively inserted into one punch hole to fasten the belt at a comfortable position for a user.

However, the conventional belt has following disadvantages: to remove the belt, a user needs to apply force to pull the belt in the opposite direction of original entry and pull the prong out of the punch hole of the belt at a specific angle and then pull the belt out from the buckle, which is inconvenient for use. Therefore, there remains a need for a new and improved design for a belt buckle to overcome the problems presented above.

SUMMARY OF THE INVENTION

The present invention provides a belt buckle which comprises a buckle cooperating with a belt body. The belt body comprises a connecting portion formed at one end thereof, and a plurality of punch holes arranged at the other end of the belt body. The buckle has a frame, a spring, a prong, a control unit, and a cover, and a shaft is located at one end of the frame. The shaft of the frame is adapted to pivotally connect to the connecting portion of the belt body, and a connecting base is formed at the other end of the frame. The spring is installed in the connecting base, and an open groove is formed at a middle section of the connecting base. One end of the prong is pivotally connected to the shaft while the other end thereof is formed into a hook portion configured to penetrate through one of the punch holes. The control unit is slidably arranged in the connecting base, and an abutting block is connected to the control unit, and the spring is coupled between the connecting base and the control unit. The cover is locked on the connecting base so as to limit the positions of the spring and the control unit. The abutting block is exposed out of the connecting base so as to be pressed to move the control unit. The control unit comprises a dodging slot and a blocking portion located at positions corresponding to the open groove. When the spring is not compressed by the control unit, the blocking portion is adapted to block the open groove so as to prevent the hook portion of the prong from passing through the open groove. When the control unit is moved to compress the spring, the dodging slot is aligned with open groove such that the hook portion of the prong is configured to pass through the dodging slot and the open groove, and the belt body is adapted to quickly slide out of the buckle when the abutting block is pressed.

In one embodiment, an accommodating slot is formed in the connecting base, and the control unit has a locating slot, and the spring is accommodated in and between the accommodating slot and the locating slot so as to limit the working space of the spring.

In another embodiment, a surface of the blocking portion of the control unit, which is faced to the cover, is formed into an inclined plane, and the cover has a notch faced to the open groove, so that the hook portion of the prong is adapted to pass through the notch to press against the inclined plane of the control unit; the hook portion is configured to control the control unit to press against the spring, and the prong is adapted to directly pass through the open groove so as to enable a user to quickly secure the belt body with the buckle.

In still another embodiment, the connecting base has a protruding bar, and a sliding groove is formed between the abutting block and the control unit; the sliding groove is adapted to couple with the protruding bar so as to enable the control unit to slide along the protruding bar.

Comparing with conventional belt buckle, the present invention is advantageous because: When the belt body needs to be loosed from the buckle, a user only needs to push the abutting block of the control unit, and the control unit is adapted to slide along the protruding bar to press the spring. The shift of the control unit enables the dodging slot to align with the open groove of the connecting base, and then the hook portion of the prong can directly pass through the open groove, the dodging slot, and the notch of the cover, so that the belt body is adapted to directly slide out of the buckle, thereby achieving the quick loosen effect.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
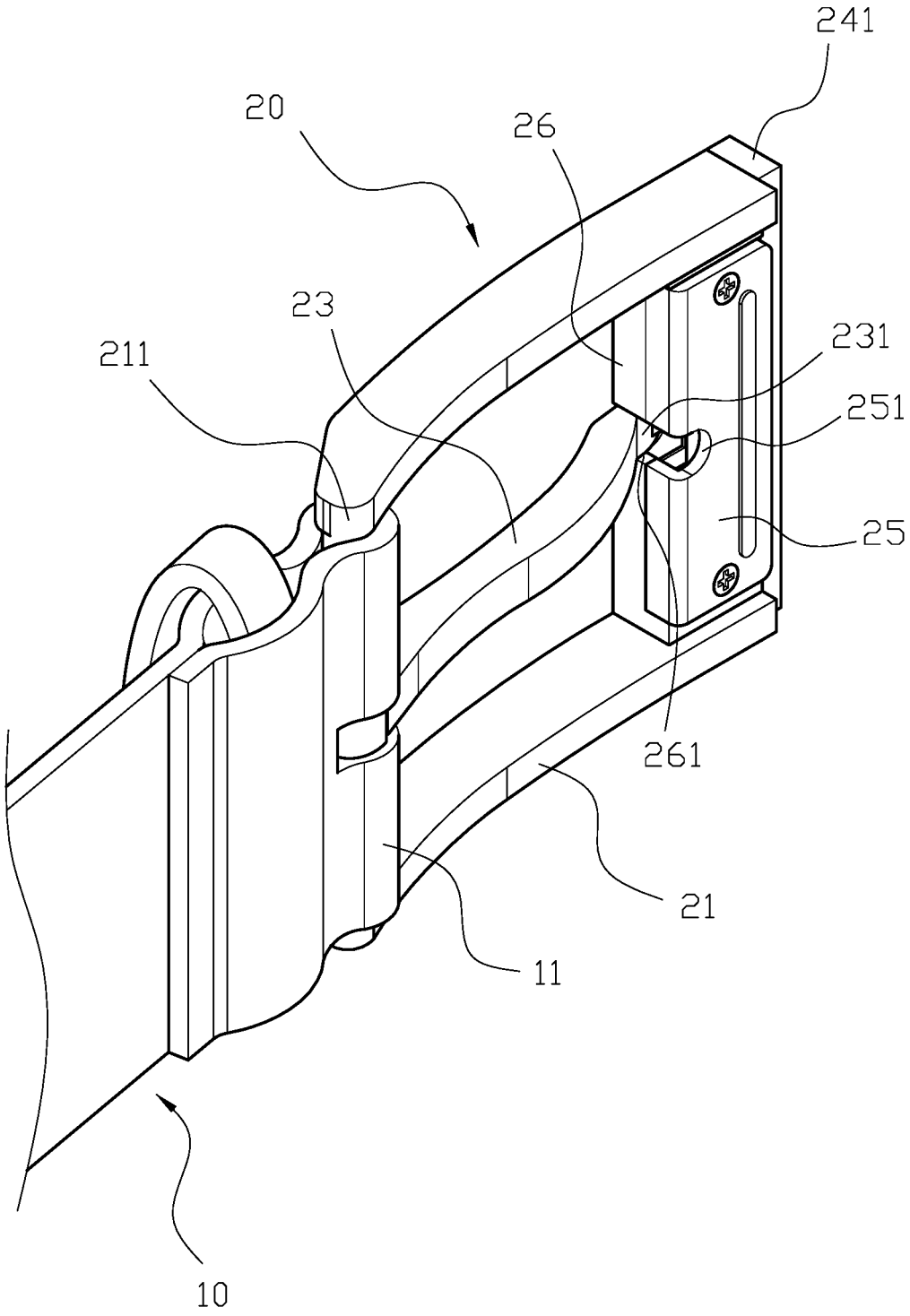
FIG. 1 is a three-dimensional assembly view of a belt buckle of the present invention.
Figure 2:
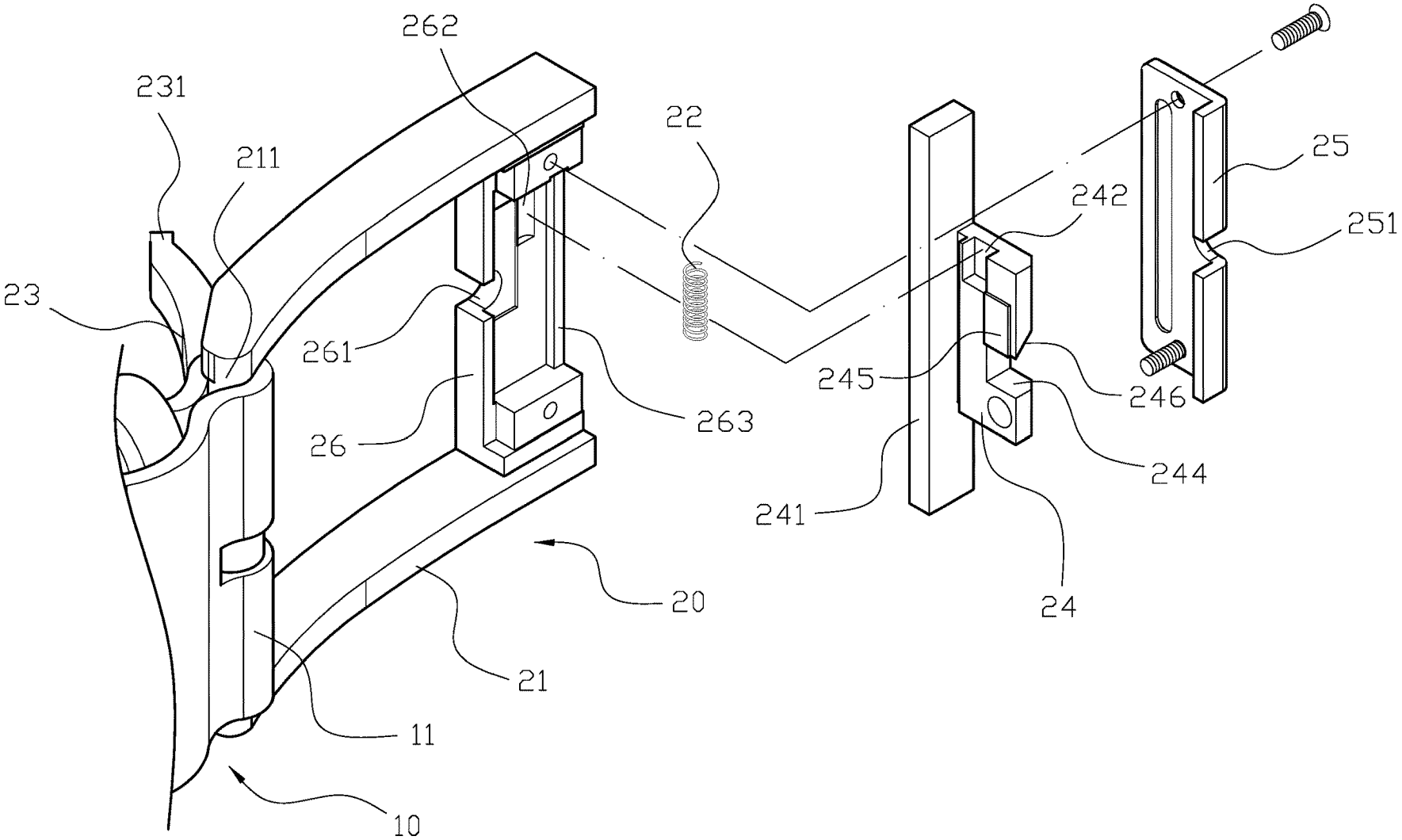
FIG. 2 is a three-dimensional exploded view of the belt buckle of the present invention.
Figure 3:
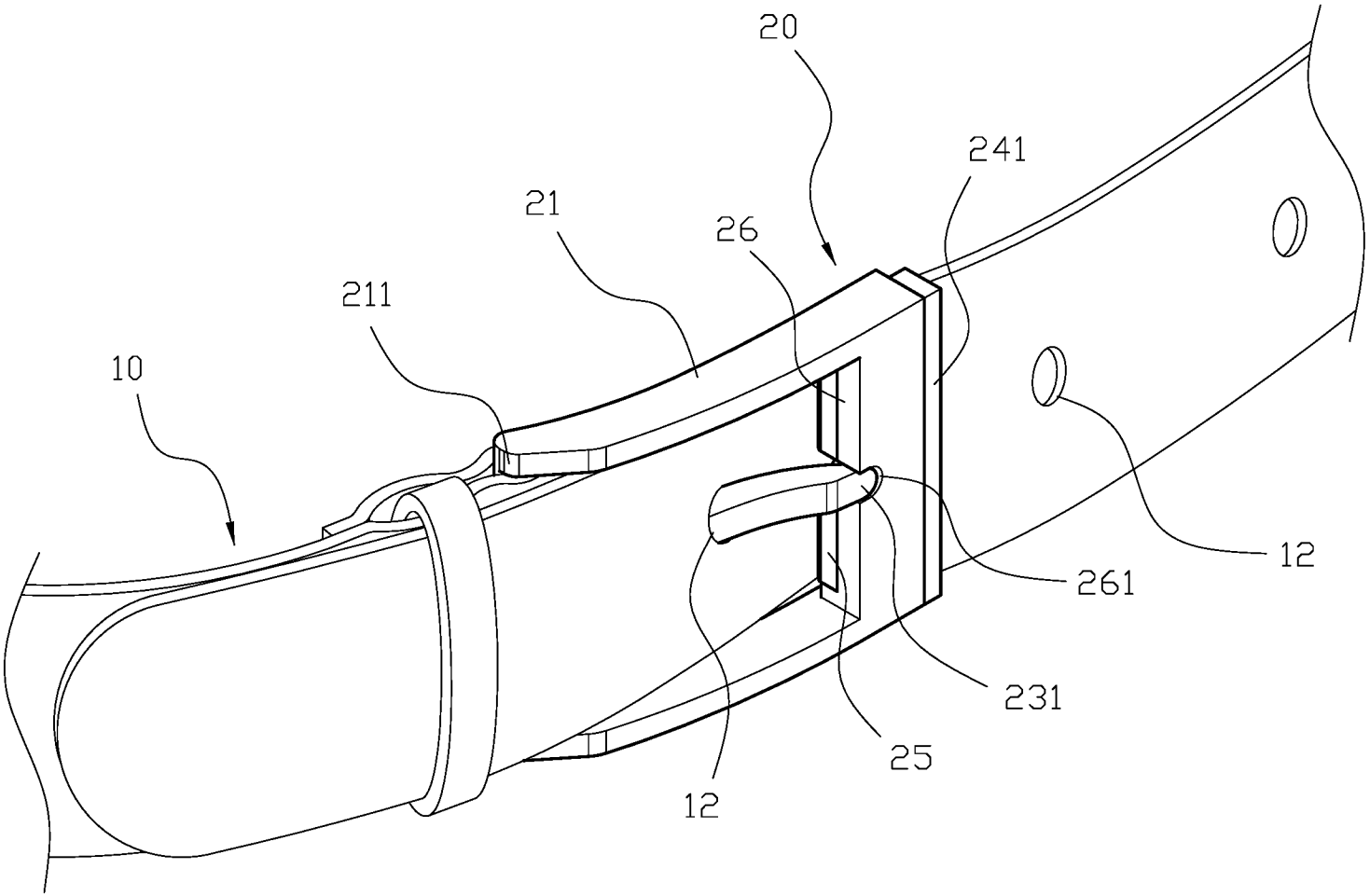
FIG. 3 is a schematic view of the belt buckle of the present invention when in use.
Figure 4:
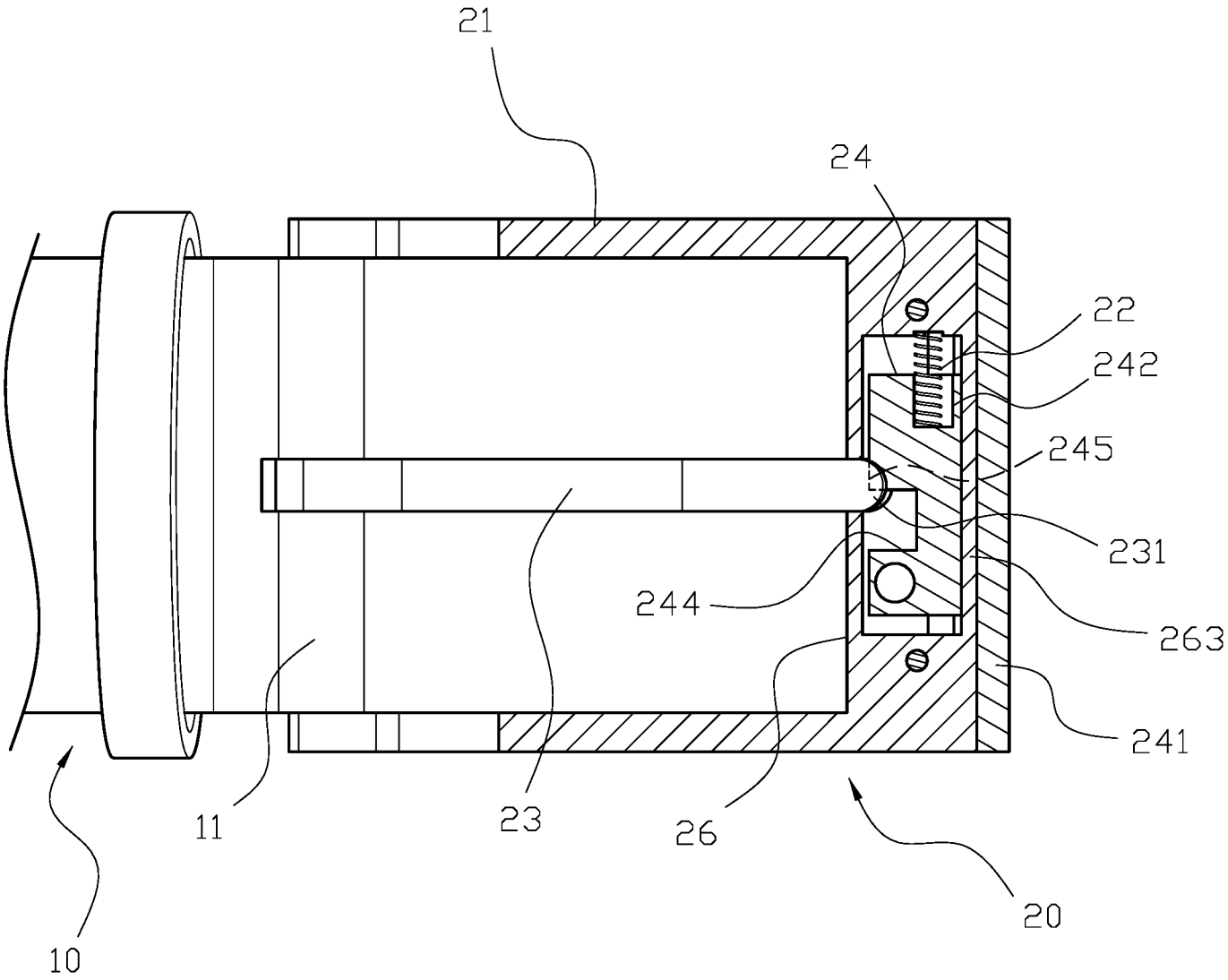
FIG. 4 is a sectional view of the belt buckle of the present invention when in use.

In order to further understand the goal, characteristics and effect of the present invention, a number of embodiments along with the drawings are illustrated as following:

Referring to FIGS. 1 to 4, the present invention provides a belt buckle which comprises a buckle (20) cooperating with a belt body (10). The belt body (10) comprises a connecting portion (11) formed at one end thereof, and a plurality of punch holes (12) arranged at the other end of the belt body (10). The buckle (20) has a frame (21), a spring (22), a prong (23), a control unit (24), and a cover (25), and a shaft (211) is located at one end of the frame (21). The shaft (211) of the frame (21) is adapted to pivotally connect to the connecting portion (11) of the belt body (10), and a connecting base (26) is formed at the other end of the frame (21). The spring (22) is installed in the connecting base (26), and an open groove (261) is formed at a middle section of the connecting base (26). One end of the prong (23) is pivotally connected to the shaft (211) while the other end thereof is formed into a hook portion (231) configured to penetrate through one of the punch holes (12). The control unit (24) is slidably arranged in the connecting base (26), and an abutting block (241) is connected to the control unit (24), and the spring (22) is coupled between the connecting base (26) and the control unit (24). Moreover, an accommodating slot (262) is formed in the connecting base (26), and the control unit (24) has a locating slot (242), and the spring (22) is accommodated in and between the accommodating slot (262) and the locating slot (242) so as to limit the working space of the spring (22). The cover (25) is locked on the connecting base (26) so as to limit the positions of the spring (22) and the control unit (24). The abutting block (241) is exposed out of the connecting base (26) so as to enable a user to press the abutting block (241) to move the control unit (24). Furthermore, the connecting base (26) has a protruding bar (263), and a sliding groove (243) is formed between the abutting block (241) and the control unit (24). The sliding groove (243) is adapted to couple with the protruding bar (263) so as to enable the control unit (24) to slide along the protruding bar (263), and the cover (25) is configured to keep the control unit (24) coupling with the protruding bar (263). In addition, the control unit (24) comprises a dodging slot (244) and a blocking portion (245) located at positions corresponding to the open groove (261). When the spring (22) is not compressed by the control unit (24), the blocking portion (245) is adapted to block the open groove (261) so as to prevent the hook portion (231) of the prong (23) from passing through the open groove (261). On the other hand, when the control unit (24) is moved to compress the spring (22), the dodging slot (244) is aligned with open groove (261) such that the hook portion (231) of the prong (23) is configured to pass through the dodging slot (244) and the open groove (261), and the belt body (10) is adapted to quickly slide out of the buckle (20) when the abutting block (241) is pressed. Additionally, a surface of the blocking portion (245) of the control unit (24), which is faced to the cover (25), is formed into an inclined plane (246), and the cover (25) has a notch (251) faced to the open groove (261), so that the hook portion (231) of the prong (23) is adapted to pass through the notch (251) to press against the inclined plane (246) of the control unit (24). Thus, the hook portion (231) is configured to control the control unit (24) to press against the spring (22), and the prong (23) is adapted to directly pass through the open groove (261) so as to enable a user to quickly secure the belt body (10) with the buckle (20).

Figure 6:
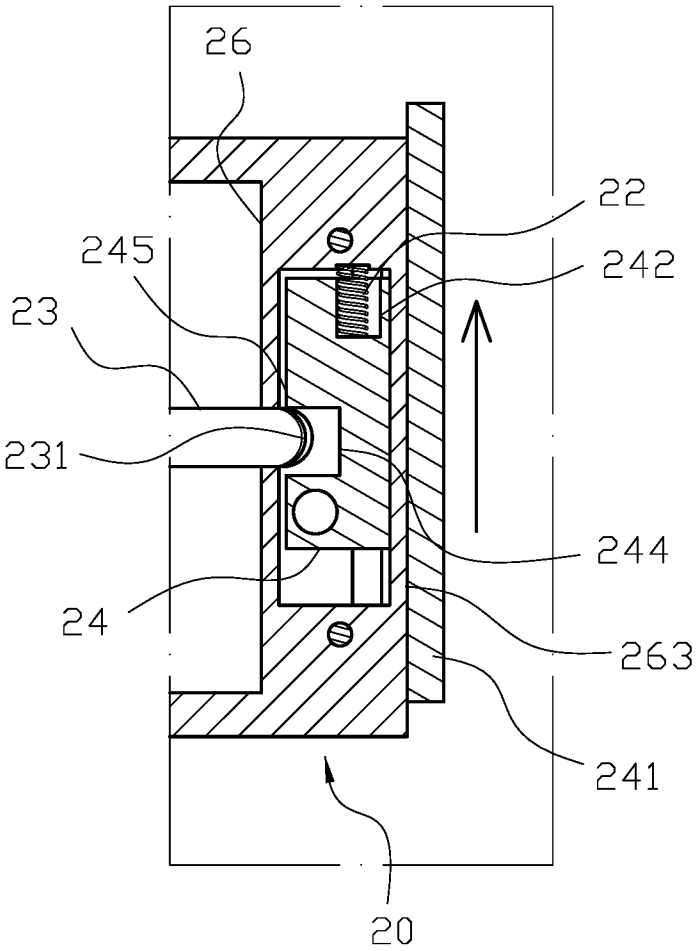
FIG. 6 is a second schematic view of the quick loosen process of the belt buckle in the present invention.
Figure 5:
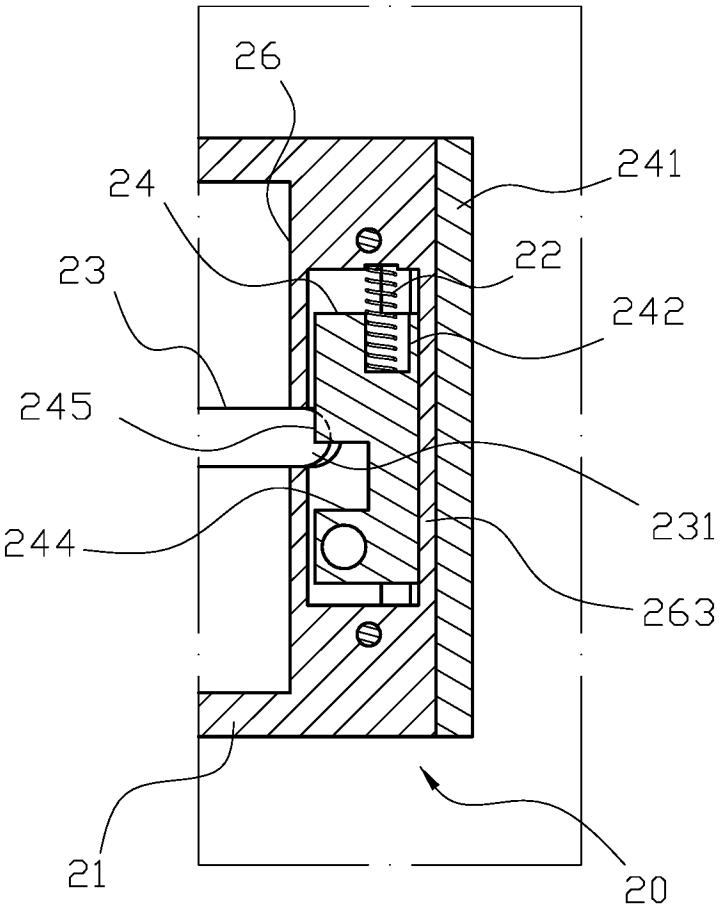
FIG. 5 is a first schematic view of the quick loosen process of the belt buckle in the present invention.
Figure 7:
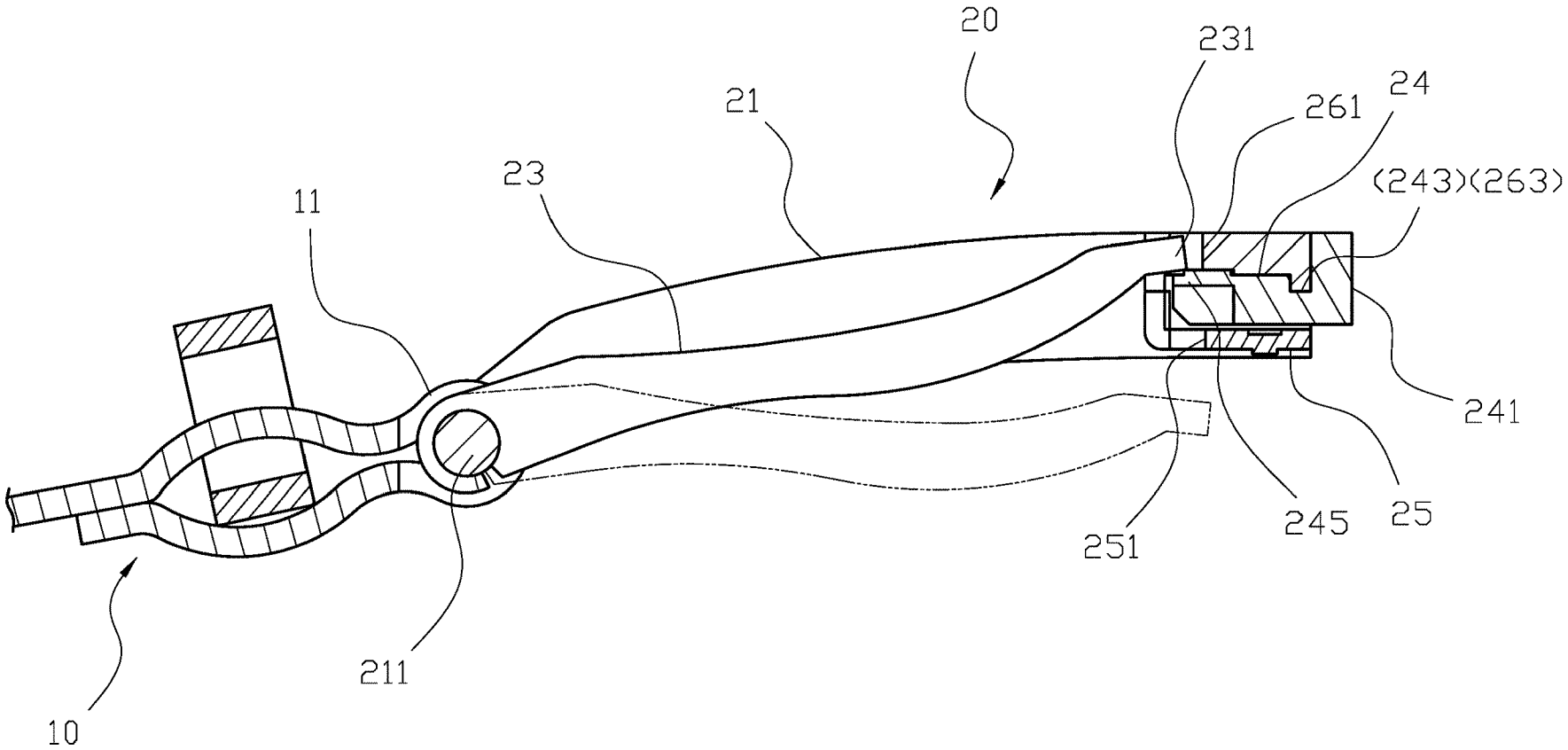
FIG. 7 is a third schematic view of the quick loosen process of the belt buckle in the present invention.
Figure 8:
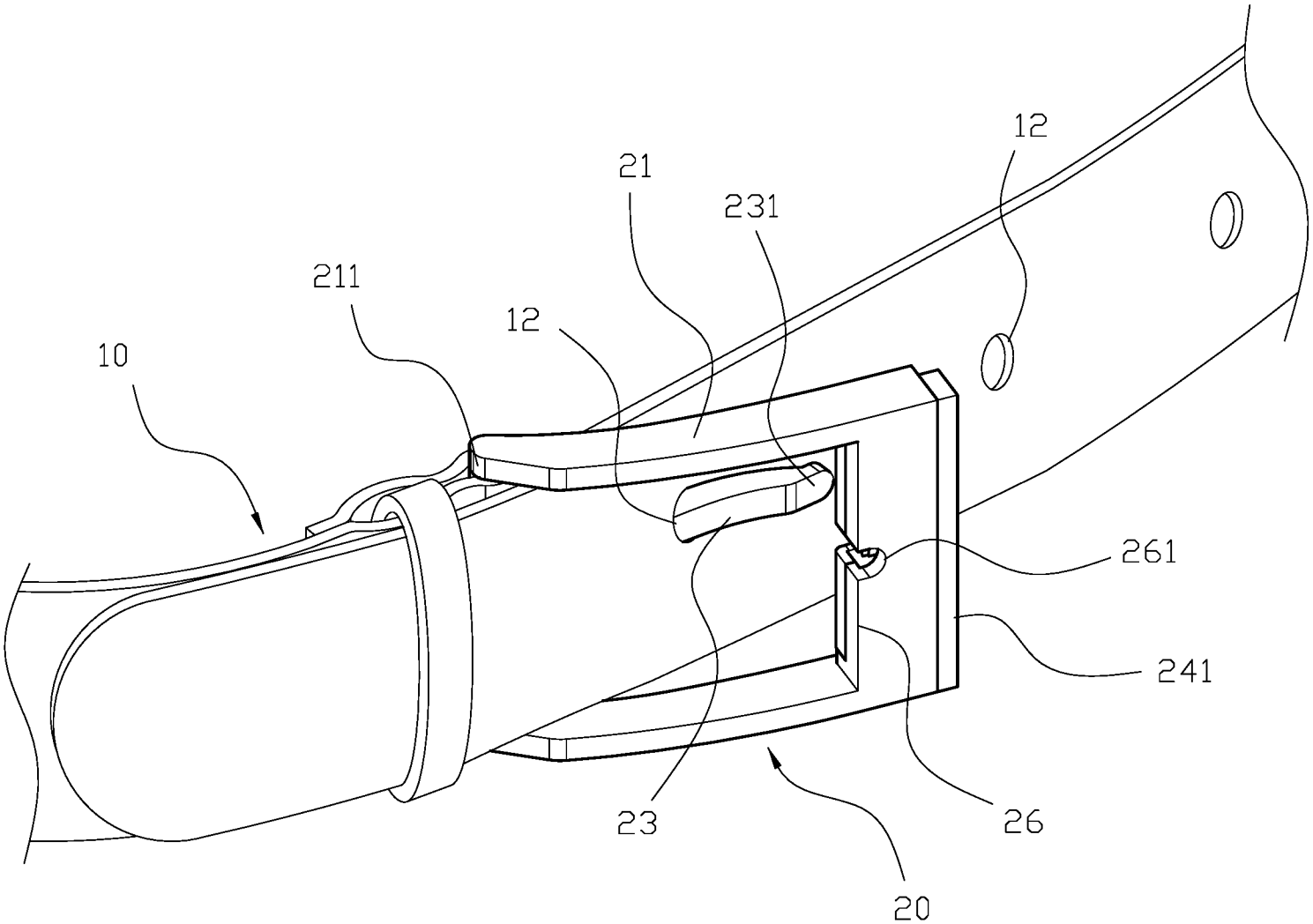
FIG. 8 is a three-dimensional schematic view illustrating a belt body slides out of a buckle of the belt buckle in the present invention.

In actual application, referring to FIGS. 2 to 8, the frame (21) of the buckle (20) is connected to the connecting portion (11) of the belt body (10) through the shaft (211), and the prong (23) is pivotally connected to the shaft (211), and the hook portion (231) of the prong (23) is faced to the connecting base (26) of the frame (21). Also, the spring (22) is arranged in the accommodating slot (262) of the connecting base (26), and the control unit (24) is installed in the connecting base (26). Moreover, the spring (22) is borne against the locating slot (242) of the control unit (24), and the sliding groove (243) of the control unit (24) is coupled with the protruding bar (263) of the connecting base (26), and the abutting block (241) is exposed out of the connecting base (26). Then, the connecting base (26) is locked on the cover (25) to complete the assembly. When the belt body (10) is to be buckled, the end of the belt body (10) having the punch holes (12) is configured to pass through the frame (21) of the buckle (20), and the hook portion (231) of the prong (23) is adapted to penetrate through one of the punch holes (12). Also, the hook portion (231) is positioned at the open groove (261) of the connecting base (26) to abut against the blocking portion (245) of the control unit (24) so as to fasten the belt body (10) with the buckle (20) at a comfortable position for a user. When the belt body (10) needs to be loosed from the buckle (20), a user only needs to push the abutting block (241) of the control unit (24), and the control unit (24) is adapted to slide along the protruding bar (263) to press the spring (22). The shift of the control unit (24) enables the dodging slot (244) to align with the open groove (261) of the connecting base (26), and then the hook portion (231) of the prong (23) can directly pass through the open groove (261), the dodging slot (244), and the notch (251) of the cover (25), so that the belt body (10) is adapted to directly slide out of the buckle (20), thereby achieving the quick loosen effect.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A belt buckle comprising a buckle cooperating with a belt body;

wherein the belt body comprises a connecting portion formed at one end thereof, and a plurality of punch holes arranged at the other end of the belt body; and wherein the buckle has a frame, a spring, a prong, a control unit, and a cover, and a shaft is located at one end of the frame; the shaft of the frame is adapted to pivotally connect to the connecting portion of the belt body, and a connecting base is formed at the other end of the frame; the spring is installed in the connecting base, and an open groove is formed at a middle section of the connecting base; one end of the prong is pivotally connected to the shaft while the other end thereof is formed into a hook portion configured to penetrate through one of the punch holes; the control unit is slidably arranged in the connecting base, and an abutting block is connected to the control unit, and the spring is coupled between the connecting base and the control unit; the cover is locked on the connecting base so as to limit the positions of the spring and the control unit; the abutting block is exposed out of the connecting base so as to be pressed to move the control unit; the control unit comprises a dodging slot and a blocking portion located at positions corresponding to the open groove; when the spring is not compressed by the control unit, the blocking portion is adapted to block the open groove so as to prevent the hook portion of the prong from passing through the open groove; when the control unit is moved to compress the spring, the dodging slot is aligned with the open groove such that the hook portion of the prong is configured to pass through the dodging slot and the open groove, and the belt body is adapted to quickly slide out of the buckle when the abutting block is pressed.

2. The belt buckle of claim 1, wherein an accommodating slot is formed in the connecting base, and the control unit has a locating slot, and the spring is accommodated in and between the accommodating slot and the locating slot so as to limit the working space of the spring.

3. The belt buckle of claim 1, wherein a surface of the blocking portion of the control unit, which is faced to the cover, is formed into an inclined plane, and the cover has a notch faced to the open groove, so that the hook portion of the prong is adapted to pass through the notch to press against the inclined plane of the control unit; the hook portion is configured to control the control unit to press against the spring, and the prong is adapted to directly pass through the open groove so as to enable a user to quickly secure the belt body with the buckle.

4. The belt buckle of claim 1, wherein the connecting base has a protruding bar, and a sliding groove is formed between the abutting block and the control unit; the sliding groove is adapted to couple with the protruding bar so as to enable the control unit to slide along the protruding bar.

* * * * *